US011186395B2

(12) United States Patent
Badini et al.

(10) Patent No.: US 11,186,395 B2
(45) Date of Patent: Nov. 30, 2021

(54) MACHINE FOR MAKING FILTER BAGS FOR INFUSION PRODUCTS

(71) Applicant: I.M.A. INDUSTRIA MACCHINE AUTOMATICHE S.p.A., Ozzano Del'Emilia (IT)

(72) Inventors: Simone Badini, Ozzano Del'Emilia (IT); Federico Bovicelli, Ozzano Del'Emilia (IT); Sauro Rivola, Ozzano Del'Emilia (IT)

(73) Assignee: I.M.A. INDUSTRIA MACCHINE AUTOMATICHE S.P.A., Ozzano Dell'emilia (IT)

( * ) Notice: Subject to any disclaimer, the term of this patent is extended or adjusted under 35 U.S.C. 154(b) by 141 days.

(21) Appl. No.: 16/618,960

(22) PCT Filed: Jul. 3, 2018

(86) PCT No.: PCT/EP2018/067874
§ 371 (c)(1),
(2) Date: Dec. 3, 2019

(87) PCT Pub. No.: WO2019/007924
PCT Pub. Date: Jan. 10, 2019

(65) Prior Publication Data

US 2021/0276747 A1 Sep. 9, 2021

(30) Foreign Application Priority Data

Jul. 4, 2017 (IT) ..... 102017000074573

(51) Int. Cl.
*B65B 29/00* (2006.01)
*B65B 29/02* (2006.01)
(Continued)

(52) U.S. Cl.
CPC ..... *B65B 29/028* (2017.08); *B65B 7/08* (2013.01); *B65B 43/50* (2013.01)

(58) Field of Classification Search
CPC ..... B65B 29/028; B65B 29/04; B65B 43/50
See application file for complete search history.

(56) References Cited

U.S. PATENT DOCUMENTS 2,823,502 A * 2/1958 Rambold ..... B65B 29/028 53/133.3
5,802,820 A * 9/1998 Romagnoli ..... B65B 61/24 53/525
(Continued)

FOREIGN PATENT DOCUMENTS

CN 1037117 A 11/1989
CN 1483647 A 3/2004
(Continued)

OTHER PUBLICATIONS

International Search Report dated Aug. 13, 2018 from counterpart PCT App No. PCT/EP2018/067874.
(Continued)

*Primary Examiner* — Andrew M Tecco
(74) *Attorney, Agent, or Firm* — Shuttleworth & Ingersoll, PLC; Timothy J. Klima

(57) ABSTRACT

A machine for making filter bags for infusion products includes a first carousel for continuous rotary movement about a first axis and having first operating stations movable therewith, each first operating station configured to operate on a corresponding piece of filter material fed along an angular stretch of the first carousel, to lift two chambers to a position side by side. A second carousel positioned alongside the first carousel and rotating continuously about a second axis parallel to the first axis has a plurality of joining elements positioned along, and continuously movable with, the second carousel. Each joining element is connected to
(Continued)

corresponding control devices for actuating, in a synchronized fashion, a succession of movements of the joining element to intercept free ends of erect filter material, positioned on an operating station and joining them, towards one of the two chambers containing a dose of product.

12 Claims, 5 Drawing Sheets

(51) Int. Cl.
*B65B 7/08* (2006.01)
*B65B 43/50* (2006.01)

(56) References Cited

U.S. PATENT DOCUMENTS 5,852,917 A * 12/1998 Romagnoli ..... B65B 29/028 53/479
5,870,880 A * 2/1999 Romagnoli ..... B65B 29/04 53/134.2
6,499,273 B1 * 12/2002 Marzocchi ..... B65B 29/04 493/226
6,837,024 B1 * 1/2005 Romagnoli ..... B65B 29/028 53/170
8,333,050 B2 * 12/2012 Rea ..... B29C 66/1122 53/134.2
10,793,347 B2 * 10/2020 Rea ..... B65B 29/04
2017/0233120 A1 * 8/2017 Spatafora ..... B65D 85/808 53/134.2

FOREIGN PATENT DOCUMENTS

CN 104936862 A 9/2015
EP 762973 A1 3/1997
EP 762974 A1 3/1997
EP 0765274 A1 4/1997
EP 0842852 A1 5/1998
EP 1384664 A1 1/2004
WO 2016029987 A1 3/2016

OTHER PUBLICATIONS

Chinese Office Action dated Jan. 28, 2021 from counterpart Chinese Patent Application No. 201880044966.1.

* cited by examiner

MACHINE FOR MAKING FILTER BAGS FOR INFUSION PRODUCTS

This application is the National Phase of International Application PCT/EP2018/067874 filed Jul. 3, 2018 which designated the U.S.

This application claims priority to Italian Patent Application No. 102017000074573 filed Jul. 4, 2017, which application is incorporated by reference herein.

The present invention relates to a machine for making filter bags for infusion products, such as tea, coffee, camomile (in powdered, granular or leaf form).

The term filter bags can refer to at least two types of filter bags: single-chamber filter bags comprising, in a minimal configuration, a piece of filter material forming a chamber containing a dose of infusion product; and double-chamber filters, also comprising a single piece of filter paper but formed into two separate chambers. Each chamber contains a dose of infusion product. The two chambers are folded towards each other, forming a single top end (in the shape of an upside-down "V") and a bottom end in the shape of a "W".

Single- and double-chamber filter bags can also be provided with a tag and a piece of string that connects the tag to the filter bag.

Lastly, the filter bags described can come with a packaging wrapper that envelops and closes, either hermetically or not, the single filter bag.

Such a type of machine, used for forming filter bags of the two-lobed type, is known from patent documents EP762973, EP762974 and EP765274 (all by the present applicant).

WO 2016/029987 describes a machine for making filter bags having a first carousel having a plurality of first operating stations.

The machine extends along a shaping and feeding line in which there are:

a feeding station for a strip of filter material advancing along a feeding plane;

a feeding station for adding doses of product onto the strip of filter material at preset distances;

a tubing station for folding the strip onto itself, wrapping the doses of product and subsequently joining the strip along the longitudinal side;

a folding station of single pieces of filter material with double chambers;

a carousel, with radially extending grippers, positioned below the folding station and configured to receive single pieces of folded filter material; the carousel moves in stepped rotation around a horizontal axis, rotating each piece of filter paper at the operation stations, placed in succession and stationary with respect to a frame of the machine to attach a piece of string to the piece of filter material, conveniently wound around the same piece of filter material, and a tag that is in its turn attached to the string.

In some solutions, depending on the type of filter bag to be formed, the machine can (alternatively) have:

a folding station for the open ends of the two chambers of the piece along the path of the carousel, being held through the tying of the thread onto the piece itself; or a further transverse closing station for closing the ends of the piece, prior to or at the same time as the separation of the remainder of the strip.

The machine can also contain an application station to apply a packaging wrapper for each filter bag, positioned along the path of the carousel or at an additional carousel.

The machine organised in such a manner operates at a discontinuous motion, that is to say with one step for all the stations along the line of advancement.

This stepped operation limits the machine's productivity.

The aim of the present invention is to provide a machine for the forming of filter bags for infusion products that has greater productivity than the machines of the prior art, maintaining a high level of quality for the filter bags.

More particularly, the aim of the present invention is to provide a machine for the forming of filter bags for infusion products that takes up less space and that has greater flexibility.

These aims are fully obtained by a machine for the forming of filter bags for infusion products in accordance with the claims below.

The invention will now be described with reference to the enclosed figures, provided as non-limiting example, wherein:

FIG. 1 illustrates a machine for forming filter bags for infusion products according to the present invention, in a schematic front view with some parts removed in order to highlight others;

FIGS. 2 to 5 each illustrate the machine of FIG. 1 in corresponding different operating positions, all figures are front views with some parts removed in order to highlight others;

Figure 1:
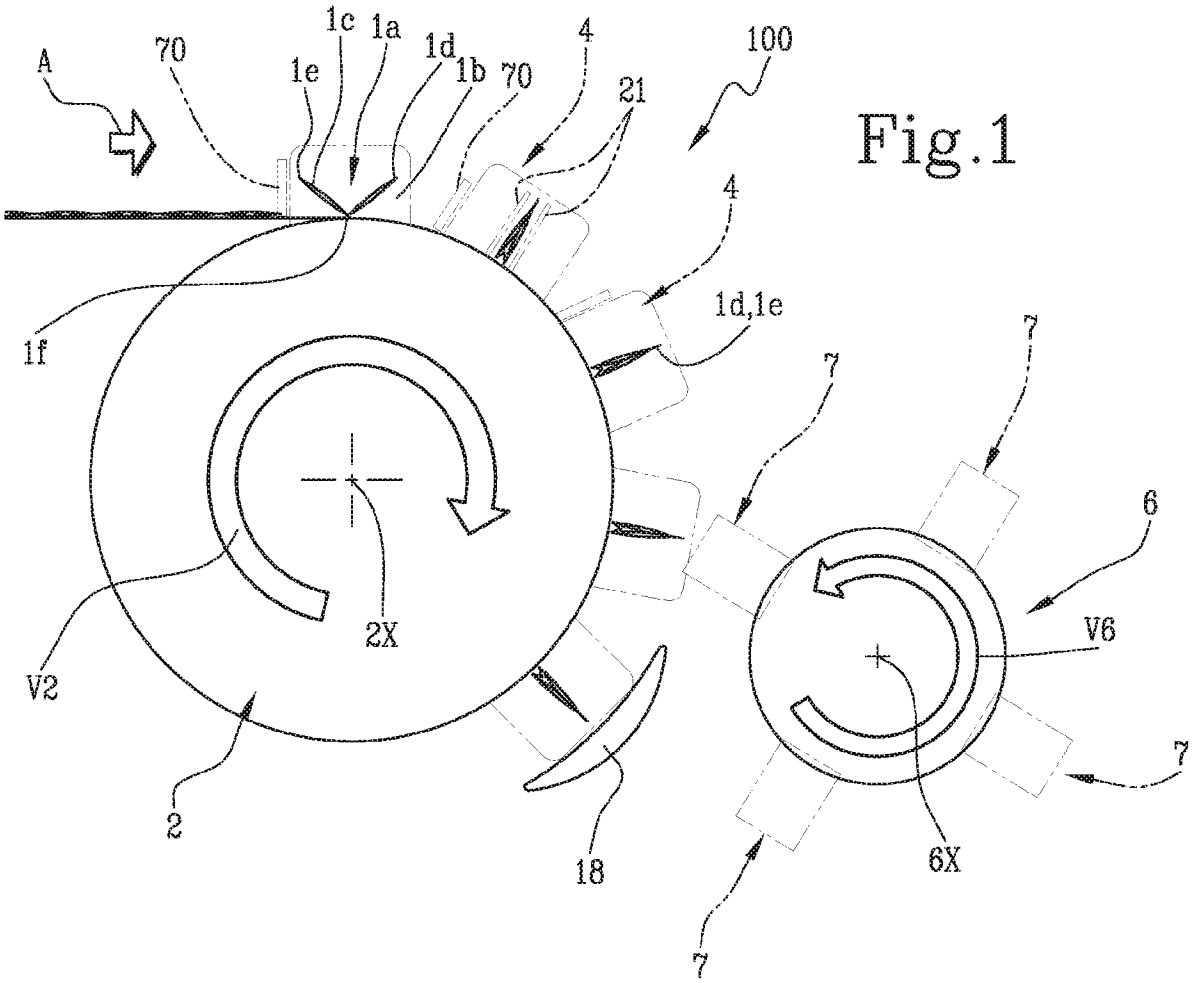

With reference to the enclosed figures, a machine in accordance with the present invention, indicated in general by the number 100 in FIGS. 1-5, is used for the forming of filter bags 1 containing infusion products, such as tea, coffee, camomile, in doses of powder, granules or leaves.

The term filter bags 1, in the present description, is intended to indicate so-called double-chamber filter bags.

This type of filter bag 1 comprises a single piece 1*a* of filter material, which defines two separate chambers 1*b*, 1*c*. Each chamber 1*b*, 1*c* contains a dose of infusion product. The two chambers 1*b*, 1*c* are folded towards each other, forming a single top end (in the shape of an upside-down "V") and a bottom end in the shape of a "W".

This type of filter bag can be provided with a gripping tag and a string that connects the tag to the folded filter bag 1 (tag and string not illustrated).

An external packaging wrapper can be added that envelops and closes each separate folded filter bag 1.

The primary objective of the machine 100 of the present invention is to form at least the geometric shape of the double-chamber filter bag 1 by departing from a piece 1*a* of filter material and manipulating it as necessary.

The machine 100 in question can be used separately or as part of a more complex group of machines, adding, where necessary, operating stations that carry out the requested operation on the piece of filter material or filter bag (application of the string and tag, an/or application of an external packaging wrapper, etc.), while the machine remains in continuous operation.

The machine 100 for forming filter bags 1 for infusion products operates on the basis of pieces 1*a* of filter material each having two free ends 1*d*, 1 *e* and an intermediate portion 1*f* (which will eventually form the "W"-shaped bottom end).

Between each free end 1*d*, 1*e* and the intermediate portion there are, respectively, two chambers 1*b*, 1*c* containing a corresponding dose of product.

Each piece 1*a* moves forward along a line of advancement A.

As illustrated, the machine 100 comprises a first carousel 2 for continuous rotary movement around a first axis 2X of rotation.

The machine 100 comprises a plurality of first gripping elements 3 positioned along, and continuously movable with, the first movement carousel 2.

Each gripping element 3 is configured for retaining a respective piece 1*a* of filter material being formed.

The machine 100 further comprises a plurality of first operating stations 4 positioned along, and continuously movable with, the first movement carousel 2.

Each first operating station 4 is associated with a corresponding first gripping element 3.

Each first operating station 4 is configured to operate on the piece 1*a* of filter material in order to form, at least partially, a filter bag 1 along a predetermined angular stretch of rotation of the first movement carousel 2.

Advantageously, the first operating station 4 cooperates with the corresponding first gripping element 3 to retain the respective piece 1*a* of filter material that is being formed.

The machine 100 also comprises a plurality of translation devices 5, associated with the first movement carousel 2 and configured for mutually translating the first operating stations 4 and the corresponding first gripping elements 3 along a direction parallel to the axis 2X of rotation (illustrated schematically here in the first station 4 depicted in FIGS. 2-5).

Essentially the basic concept of the machine 100 is the fact that it comprises multiple operational units, all performing the same operation on the piece of filter material, independently from one another and in continuous movement around an axis of rotation.

With this configuration it is possible to perform an intermediary operation on the filter bag for a great number of pieces of filter material in a brief period of time and within a reduced space (angular stretch).

Positioned on the first carousel 2 are the plurality of first operating stations 4, the corresponding plurality of gripping elements 3 and the plurality of translation devices 5.

In the illustrated example, pieces of filter material in tubular form are fed to the first movement carousel 2 and the operational stations are folding stations for folding, that is to say erecting, the piece to create a filter bag as yet without string and tag.

Thus the first operating station 4 can be configured to perform intermediary operations on the piece 1*a* of filter material (folding and erecting the piece), or alternatively perform finishing operations and form a complete filter bag 1 on the basis of one piece of filter material (apply the string and tag to folded and closed pieces), along at least a predetermined angular stretch of rotation of the first movement carousel 2.

From these examples it is already possible to see that the proposed solution features high operational flexibility combined with high productivity.

Because of the structure of the units, each composed of gripping elements, operating stations, and translation devices distributed along the carousel, it is possible to simplify the actuator and control groups and, preferably, to bring them together in proximity to the axis of rotation in order to reduce the bulk of the machine while maintaining high operational precision.

In the specific case illustrated here the machine 100 in accordance with the invention is able to produce (as mentioned before) double-chamber filter bags on the basis of a continuous tubular strip of filter material containing doses of product placed in succession.

In particular, the machine 100 illustrated here has the task of defining the two-lobed pieces 1*a* and fold them into an erect shape with the top ends joined and the bottom end already in the shape of a "W".

According to what is illustrated in FIG. 1, a continuous strip of filter material in tubular form having a succession of doses of infusion product placed at a distance from each other is fed to the first movement carousel 2.

The continuous strip advances in a continuous fashion along the line of advancement A in a direction V2 of advancement towards the first carousel (which has a direction V2 of rotation).

The machine 100 can comprise a plurality of cutting elements 70 positioned on, and movable in rotation with, the first movement carousel 2. Each cutting element 70 is positioned between, and associated with, a first operating station 4 and the corresponding first gripping element 3 (here illustrated schematically in FIGS. 2-5).

The cutting elements 70 are configured for separating the continuous strip of filter material in order to obtain a single piece 1*a* of filter material having two free ends 1*d* and 1*e* and an intermediate portion 1*f* (which will, as mentioned before, become the bottom of the formed filter bag 1). Between each free end 1*d* and 1*e* and the intermediate portion 1*f* there are two respective chambers 1*b*, 1*c* containing a corresponding dose of product.

It should be noted that the first movement carousel 2 rotates in continuous clockwise motion (direction V2).

According to what is illustrated, each operating station 4 (in phase coordination with the gripping elements 3 and the translation devices 5) is configured to retain and operate on a corresponding piece 1*a* of filter material fed along at least a predetermined angular stretch of rotation of the first movement carousel 2, to obtain at least a lifting of the two chambers 1*b*, 1*c* to a position side by side and erect, that is to say, positioned radially relative to the first axis 2X of rotation, and with the corresponding free ends 1*d*, 1 *e*, positioned alongside each other and further from the first carousel 2.

Each first station 4 comprises lifting elements 21 to lift the piece 1*a* of filter material.

According to what is illustrated, the machine 100 comprises a second movement carousel 6 positioned alongside the first movement carousel 2, and rotating continuously about a second axis 6X of rotation parallel to the first axis 2X of rotation.

The second carousel 6 has a plurality of joining elements 7, positioned along and continuously movable with the second carousel 6.

Each joining element 7 is connected to corresponding control devices 8 and 9 configured to provide, in synchronised fashion with the corresponding rotations of the first 2 and second 6 carousel and at least along a predetermined curved stretch, a succession of movements of the joining element 7 in order to intercept the free ends 1*d*, 1*e* of an erected piece 1*a* of filter material, positioned on an operating station 4, and to join the ends towards one of the two chambers 1*b*, 1*c* containing a dose of product.

Essentially, the machine 100 comprises at least two carousels positioned alongside each other and in continuous and synchronised movement with each other: the first carousel takes and defines the piece of filter material and then lifts it into a position that is radially projecting from the first carousel; the second carousel intercepts the single pieces during their rotation and applies the joining of the free ends of the two chambers with the doses.

As will be shown in the following description, the term joining is defined as an operation by the corresponding elements that permits the closing of the chambers, either temporary of permanently (through an operation on the open free ends), in order to ensure that the chambers with the doses remain sealed during the subsequent steps of transferring and manipulating the piece.

More particularly, in the present description the term joining refers in particular to a step in which the free ends are folded so that the closing of the chambers is ensured, but this does not preclude that the operation obtained by the solution that is the subject of the present invention could be obtained by another type of joining.

Preferably the second carousel 6 has a number of joining elements 7 that is lower than the number of operating stations 4 present on the first carousel 2 (see FIG. 1).

Preferably the second carousel 6 rotates at a speed that is different (preferably higher) and constant with respect to the speed of rotation of the first carousel 2 with its direction V6 of rotation inverse (counterclockwise) to the direction V2 of rotation of the first carousel 2.

In an alternative solution, the second carousel 6 rotates at a different and variable speed than the speed of rotation of the first carousel 2 and with its direction V6 of rotation inverse (counterclockwise) to the direction V2 of rotation of the first carousel 2.

In this second case the second carousel could have variations in acceleration and deceleration at the tangent and contact points where the joining elements approach, join and distance themselves from the piece of filter material.

In the rest of the description an embodiment of the machine will be described in which the second carousel has joining elements that fold the ends of the piece of filter material, but this is not in any way limiting of the scope of protection of the present invention. Thus, the elements 7 will be indicated as folding elements 7 in the rest of the description.

As already mentioned above, the elements that are present on the second carousel can have joining devices (heat or ultrasound sealing), either separately or in combination with folding elements to join the ends of the piece of filter material.

In the illustrated case, each joining element 7 comprises a gripper composed of two separate first 7*a* and second 7*b* claws articulated along corresponding axes X7*a*, X7*b* of independent rotation, parallel to each other, and parallel to the second axis 2X of rotation.

In this light, each first 7*a* and second 7*b* claw is connected to a corresponding first 8 and second 9 control device.

Figure 2:
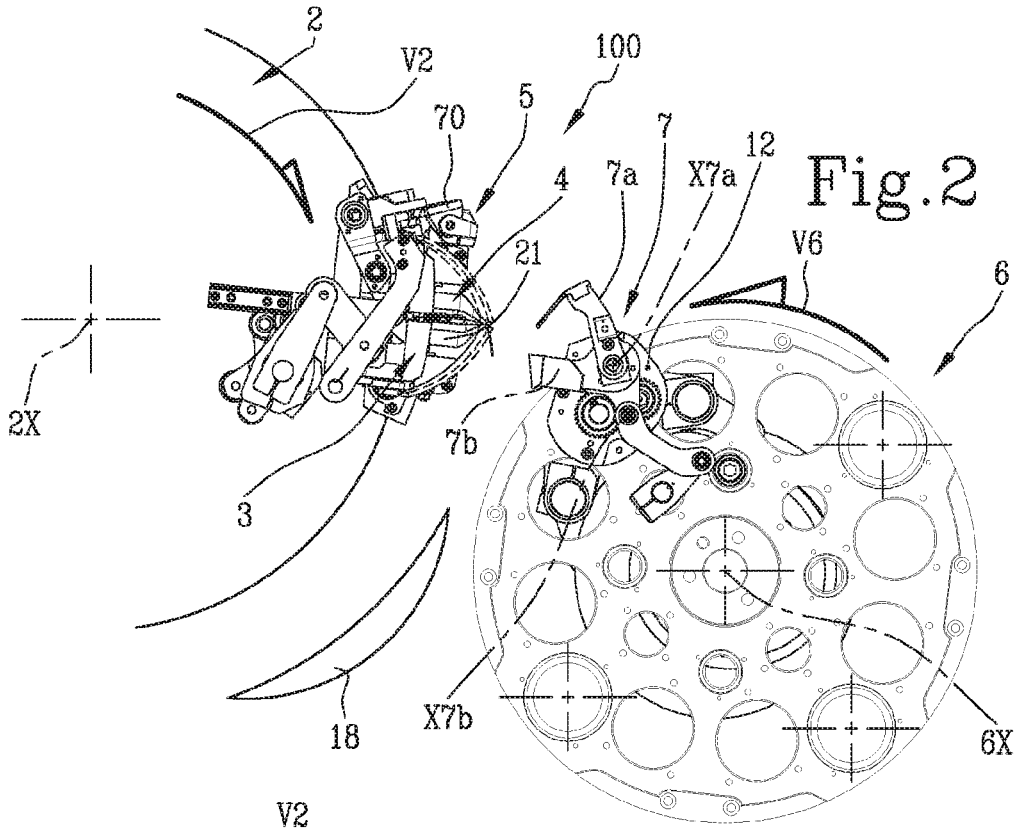
Figure 3:
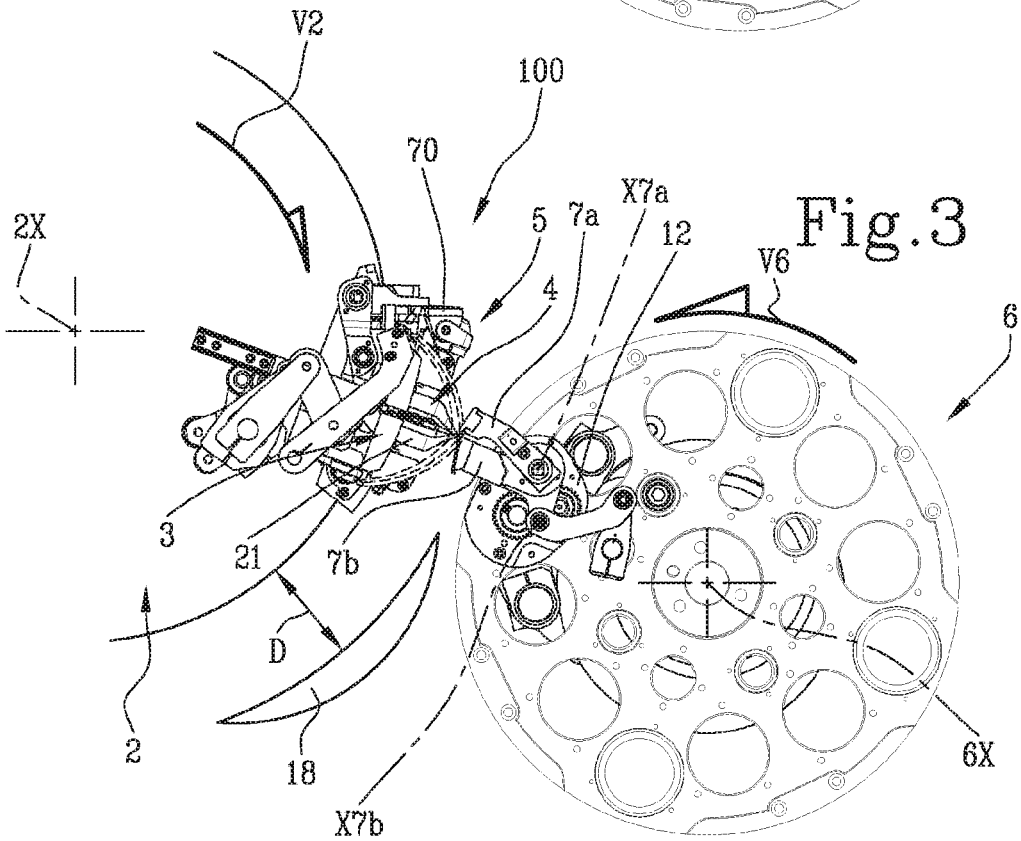
Figure 4:
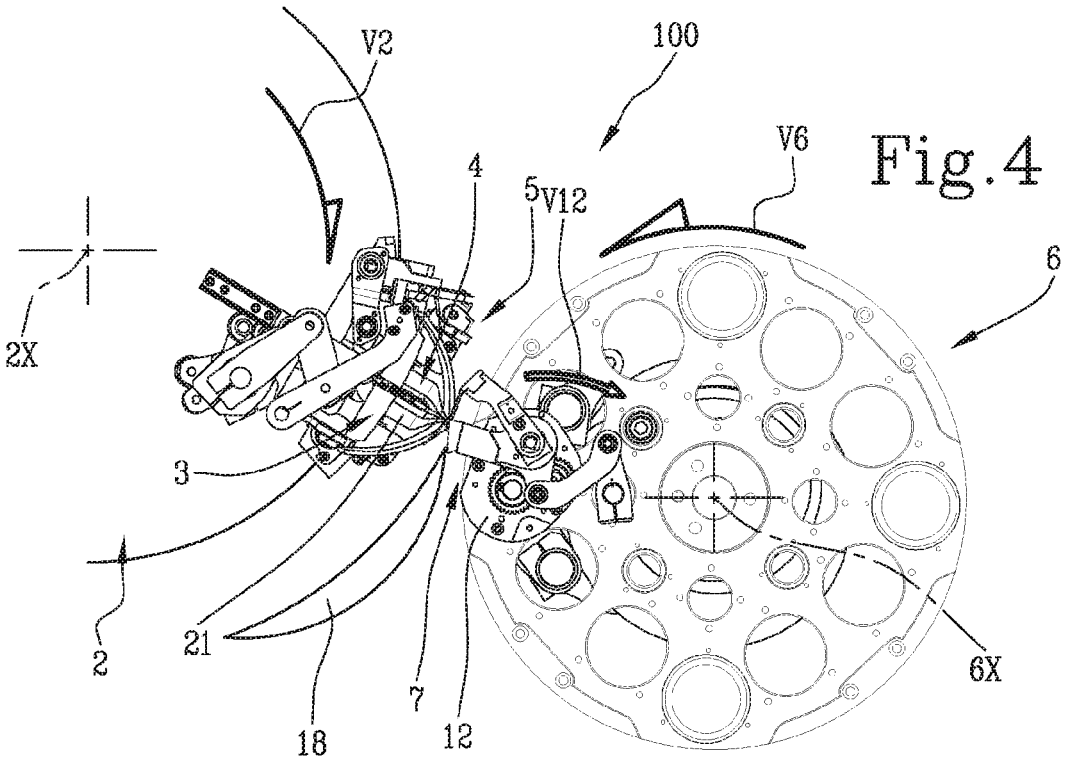
Figure 5:
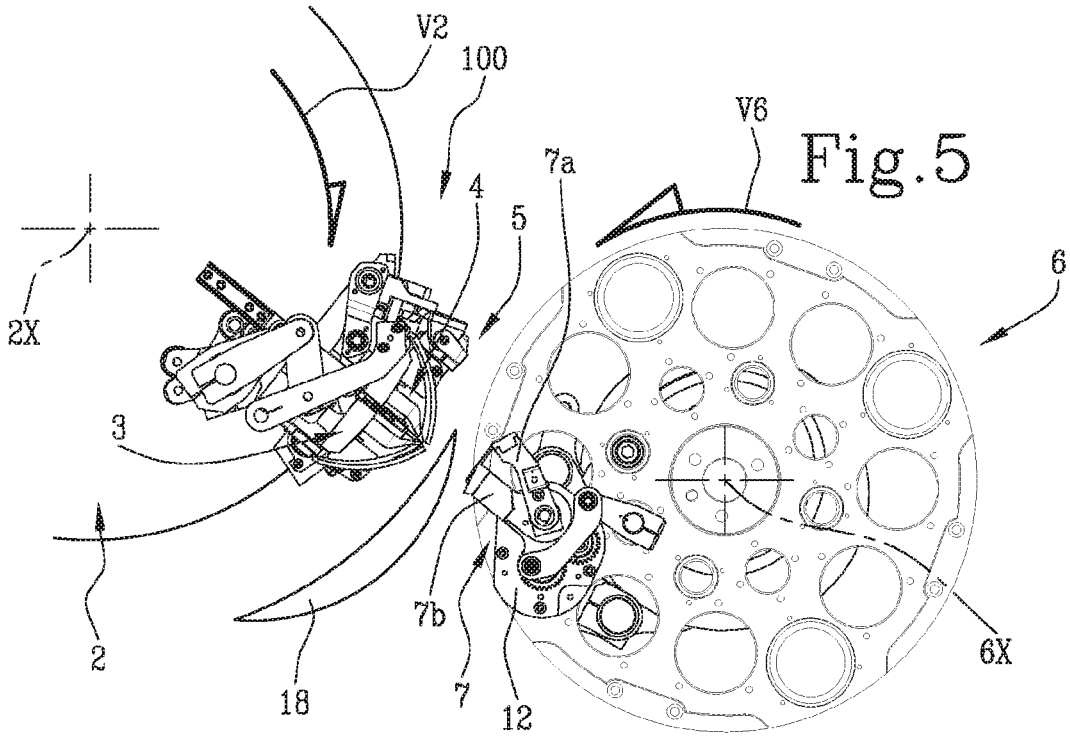

Each first 8 and second 9 control device has at least a first 8*a* and a second 9*a* motion-transmitting shaft connected by a kinematic mechanism to corresponding cam means 10 and 11 positioned inside the second carousel 6 so as to allow a synchronised movement of the two claws 7*a*, 7*b* between at least a non-operating position, wherein the two claws 7*a*, 7*b* are spaced apart (FIG. 2), and an operating position for joining the free ends 1*d* and 1 *e* of the piece 1*a* of filter material, wherein the two claws 7*a*, 7*b* are in contact with each other and protruding radially from the second carousel 6 (FIG. 3).

It should be noted that the machine 100 comprises an operating plate 12 interposed between the second movement carousel 6 and each gripper positioned on the second movement carousel 6.

In this light, each plate 12 is articulated along an axis X12 that is parallel to the second axis 6X of rotation.

It should be observed that each plate 12 is connected to a corresponding third control device 13 having a third motion-transmitting shaft 13*a* connected by a kinematic mechanism to cam means 14 placed inside the second carousel 6 so as to allow a rotation of the plate 12, in synchronous fashion with the movement of the gripper and the rotation of the second carousel 6 at least in its relative stretch of a predetermined curved path, between several operating positions along the stretch of curved path wherein the plate 12 rotates in a direction V12 inverse to the direction V6 of rotation of the second carousel 6 to keep the axis X7*a* of rotation of the gripper at a constant distance from the first axis 2X of rotation at least at the gripper's folding position.

In other words, the plate 12 allows the adjustment of the position of the gripper with respect to the first carousel 2 (and to the piece of filter material) during the corresponding rotations and to obtain the correct contact of the gripper itself with the ends to be folded.

It should be observed that each gripper and each operating plate 12 are positioned on staggered vertical planes and parallel to a front surface of the second carousel 6 in order to project from that front surface.

Preferably the first claw 7*a* is articulated onto the operating plate 12 with its own axis X7*a* of articulation.

In this light, the second claw 7*b* has a first point of articulation that coincides with the axis X7*a* of articulation of the first claw 7*a* (so as to allow a correct approach and distancing between their operational ends) and a second point X7*b* of articulation, distanced from (staggered with) the first point of articulation, connected to the corresponding second control device 9 positioned on the second carousel 6.

This geometric architecture of the claws 7*a* and 7*b*, as will be shown in what follows, allows both a correct folding of the ends of the piece of filter material, and a rapid release/distancing of those claws with respect to the first carousel once the folding is completed.

Figure 7:
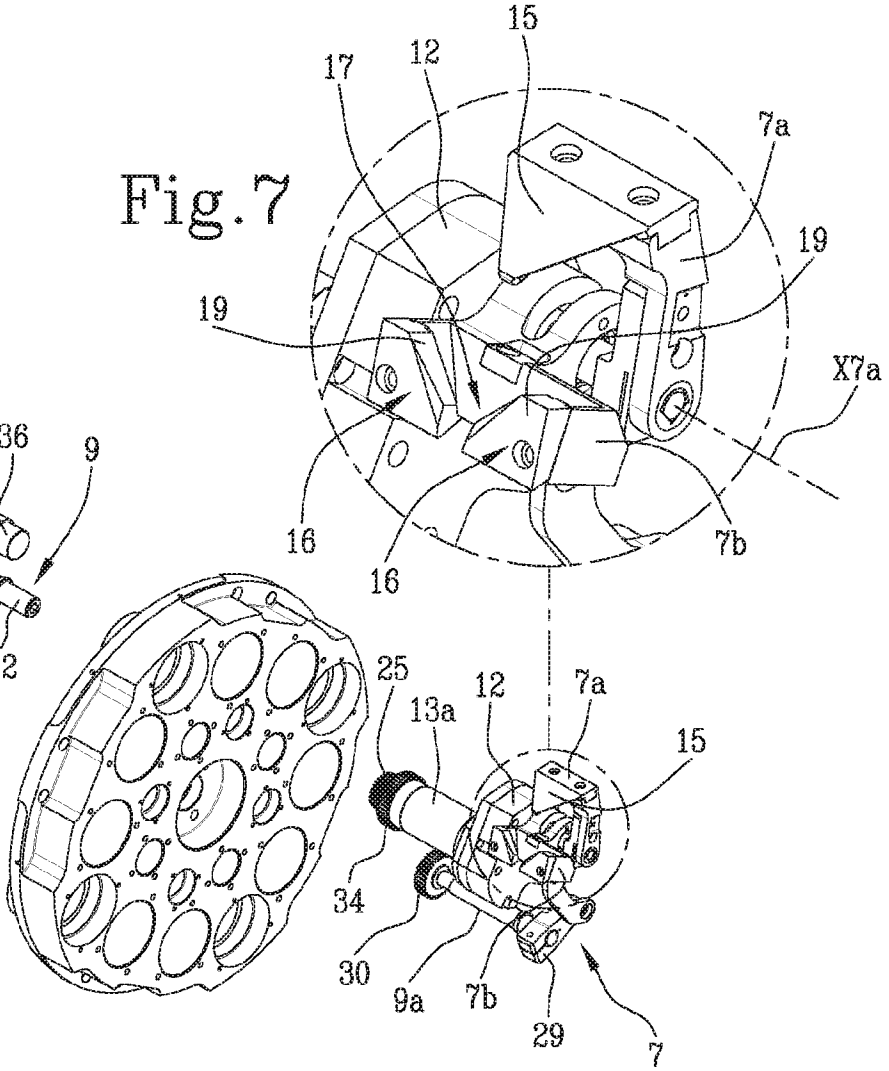
FIG. 7 illustrates an enlargement of a detail of FIG. 6.
Figures 8, 9:
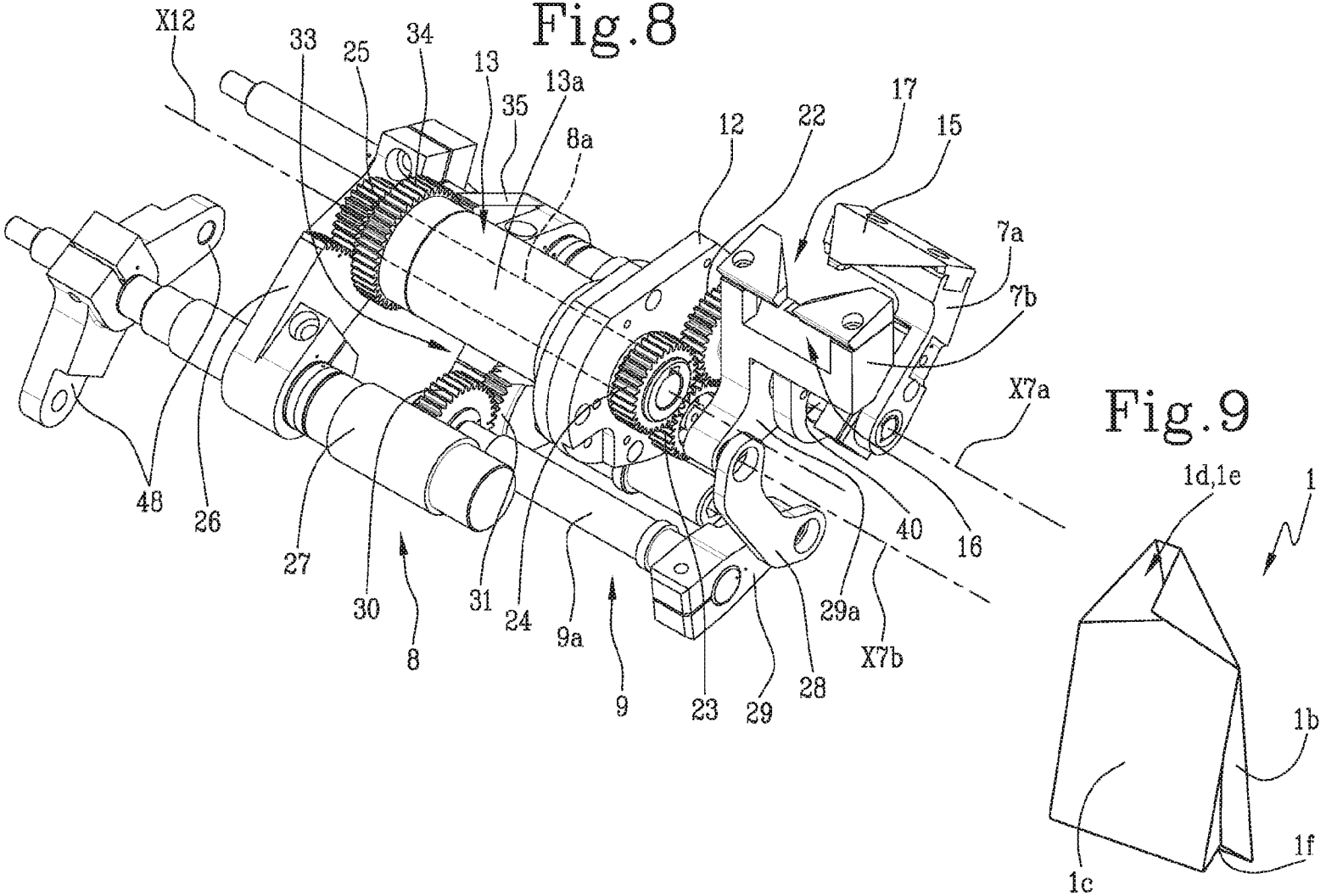
FIG. 8 illustrates a perspective view of a series of control devices of a folding station illustrated in FIGS. 2 to 7 of the joining carousel.
FIG. 9 illustrates a perspective view of a filter bag formed by the machine of the previous figures.

Preferably, see FIG. 7, each gripper has a first claw 7*a* with an operating head 15 having a plate of triangular cross section with the vertex directed towards the second claw 7*b*. In this light, each second claw 7*b* has an operating head 16 shaped in two half parts defining a central channel 17 shaped to allow, upon the approach of the triangular plate and in synergy with it, at least a first folding of the side edges of flaps of the free ends 1*d*, 1 *e* of the piece 1*a* of filter material, with partial relative superposition, towards the inside of the same piece 1*a* (see FIG. 9). In particular the side edges are folded towards an external surface of one of the two chambers of the piece of filter material containing the doses of the product.

Again in accordance with the illustration of FIG. 7, the second claw 7*b* comprises two semi-heads 19 with prismatic counterfacing shapes along corresponding surfaces that are inclined and distanced from each other in such a manner as to create the channel 17 with the portion of the closest reciprocal approach in the area below the second claw 7*b*.

Preferably the machine 100 comprises a curved contact guide 18 positioned close to the first carousel 2, at a predetermined distance D from the first carousel 2, and along its operating path for at least a predetermined stretch.

In this light, the guide 18 is positioned with its first extremity near a zone for intercepting and joining the free ends 1*d* and 1 *e* of the piece 1*a* of filter material by the folding element 7, in such a way as to keep the formed end of the piece 1*a* of filter material folded until release of the piece 1*a* from the first carousel 2.

In essence the contact guide 18 is placed downstream (with reference to direction V2 of rotation) with respect to the zone where the ends of the piece 1*a* of filter material are folded and at a distance D from the first carousel 2 that is at least equal to the dimension (calculated along a longitudinal stretch of the erect piece of filter material) of the piece of filter material with the end already folded.

In this manner the folded end of the piece 1*a* of filter material is held by the guide 18 during its transfer along the stretch where also the guide 18 is present to prevent the pliable end to return towards outwards, until the piece 1*a* comes to a zone of the first carousel 2 where it is released or processed further.

It should be observed that the presence of the guide 18 determines the necessity of an additional movement of each gripper at the end of the folding step.

Each folding element, in fact, comprises, between the first 8 and the second 9 control device and the first 7*a* and the second 7*b* claw, corresponding groups 23, 24 and 28, 29 of kinematic movement to allow the first 7*a* and second 7*b* claw of the first carousel to rotate away in a direction of rotation that is inverse to the direction V6 of rotation of the second carousel 6, at the end of the folding (or joining) of the free ends 1*d* and 1*e* of the piece 1*a* of filter material.

Figure 6:
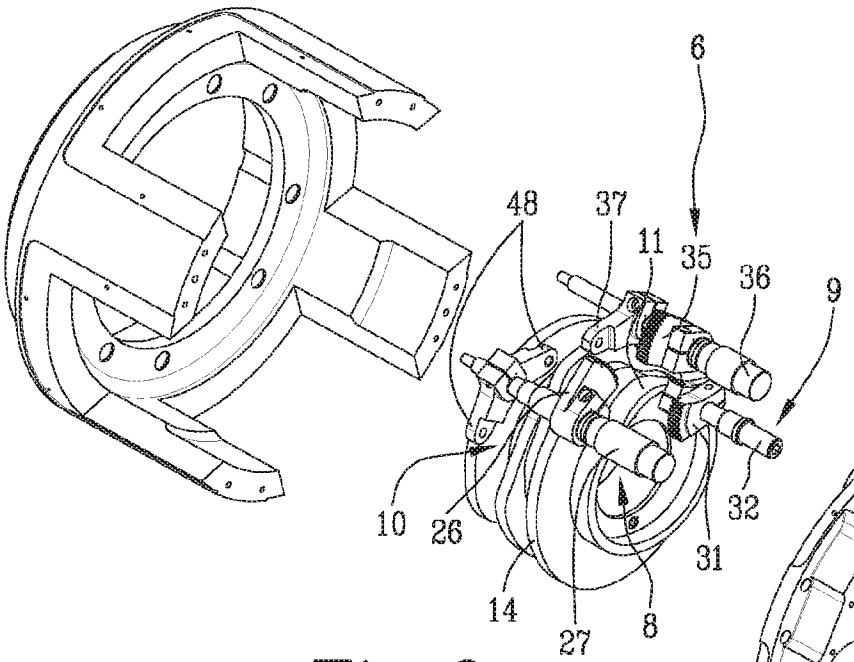
FIG. 6 illustrates a joining carousel that is part of the machine of the previous figures in an exploded perspective view.

FIGS. 6 and 7 illustrate, as a non-limiting example, the control devices 8, 9 and 13 of the pair of claws 7*a* and 7*b* and the operating plate 12.

The first control device 8 of the first claw 7*a* comprises an arm 40 of articulation (defining the axis X7*a* of articulation) of the claw 7*a* to the operating plate 12.

The arm 40 is fitted to a first toothed wheel 22 that is rotatably supported by the operating plate 12.

The first toothed wheel 22 is part of a group of three toothed wheels 22, 23 and 24 that mesh together (and of which one, the middle wheel 23, is idle) and that are all positioned on the plate 12 to transfer the movement from the shaft 8*a* to the first claw 7*a*. The structure of this group of three wheels allows also the first claw 7*a* to rotate in a direction inverse to the second wheel 6 with the operating plate 12 stationary.

The third toothed wheel 24 is fitted to an extremity of the above-mentioned shaft 8*a* that passes inside the (tubular) shaft 13*a* that is part of the control device 13 of the plate 12.

The shaft 8*a* has a further fourth toothed wheel 25 at its end, inside the second carousel 6. The fourth toothed wheel 25 is meshed with a first curved toothed section 26 fitted to a third shaft 27 (having an axis that runs parallel to the second axis 6X of rotation) and which is positioned inside the second carousel 6.

The third shaft 27 has an extremity provided with cam-following rollers 48 that are in contact with an annular cam 10 track that is part of the second carousel in order to provide the movement of the first claw 7*a*.

The second control device 9 of the second claw 7*b* comprises a crankshaft system with a crank 28 and a rod 29, in which the crank 28 is articulated with a flange 29*a* of the second claw 7*b*.

The rod 29 is articulated at one end to the crank 28 and at the other end to the second shaft 9*a* (with its axis running parallel to the second axis 6X of rotation), thus defining the effective axis X7*b* of articulation of the second claw 7*b*.

The second shaft 9*a* has a fifth toothed wheel 30 fitted to its extremity on the inside of the second carousel 6. The fifth toothed wheel 30 meshes with the second curved toothed section 31 fitted to a third shaft 32 (with its axis running parallel to the second axis 6X of rotation) and positioned inside the second carousel 6.

The third shaft 32 has an extremity provided with cam-following rollers 33 that are in contact with a further annular cam 11 track that is part of the second carousel 6 in order to provide the movement of the second claw 7*b*.

With the above-mentioned crankshaft system also the second claw 7*b* is able to rotate in a direction inverse to the second wheel 6 also with the operating plate 12 stationary and in synchronicity with the first claw 7*a* for the distancing step from the first carousel 2. The third control device 13 of the plate 12 comprises the shaft 13*a* that is solidly attached to the plate 12 and that proceeds inside the second carousel 6. The tubular shaft 13*a* has a sixth toothed wheel 34 fitted to the internal extremity of the shaft 13*a* and positioned near the fourth toothed wheel 25 positioned on the shaft 8*a*.

The sixth toothed wheel 34 is meshed with a third curved toothed section 35 fitted to a fourth shaft 36 (with its axis running parallel to the second axis 6X of rotation) and positioned inside the second carousel 6.

The fourth shaft 36 has an extremity provided with cam-following rollers 37 that are in contact with an annular cam 14 track that is part of the second carousel 6 in order to provide the rotation of the operating plate 12.

This structure for each of the folding elements 7 allows a succession of movements (coordinated and always performed during the continuous rotation of the second carousel and in a predetermined stretch) that can be summed up as follows, beginning at a starting position illustrated in FIG. 2, wherein:

the gripper is in a non-operating position, with the first claw 7*a* distanced from the second claw 7*b*, and the two claws projecting from the second carousel 6 together with a portion of the operating plate 12;

the (continuous) rotation of the second carousel 6 and the adjustment rotation of the plate 12 bring the gripper to intercept the ends 1*d* and 1*e* of the piece 1*a*, more particularly the coordination between the two rotations of the first carousel 2 and the second carousel 6 brings the second claw 7*b* to a position underneath the ends 1*d* and 1 *e* and with a slight approach to the first claw 7*a*, while the first claw 7*a* moves to approach the second claw 7*b* to obtain the folding of the ends 1*d* and 1 *e* (see FIG. 3) according to the succession of folding described above and illustrated in FIG. 9;

subsequently to the folding, the two claws 7*a*, 7*b* have a relative, partial, reciprocally distancing movement to allow the release of the folded end of the piece 1*a* (see FIG. 4) just before reaching the initial extremity of the contact guide 18;

subsequently to the step of releasing the folded end, the two claws 7*a* and 7*b* are made to rotate in a direction inverse to the direction of rotation of the second carousel 6 (with plate 12 stationary) to avoid contact between the gripper and the guide 18 (see FIG. 5) and to facilitate the insertion of the folded ends into that guide 18.

During the remainder of the curved path the folding elements are repositioned in their starting configuration, as illustrated in FIG. 2.

Thanks to the structure of the machine as described here, it is possible to fully realise the established aims.

Indeed, a machine in accordance with the invention will be extremely flexible, configurable with regard to the type of filter bag to be made, and have high productivity.

It should be noted that each single operation on the piece of filter material, or on the filter bag, is no longer tied to times where the machine is stationary (contrary to machines with stepped operation) and that their durations are independent from each other. Thus it is possible to extend or shorten the time for the execution of an operation, as needed (in this case, for example, to fold the piece of filter material and seal the free ends) simply by making use of a longer or shorter stretch of rotation of the movement carousel.

Each element can operate on the piece of filter material along a much shorter curved path of the carousel, with the possibility of starting the operations in an immediate manner, thereby reducing the time spent stationary, and the bulk of the machine.

With this structure it is possible to obtain high flexibility in operation, as the joining elements described can be replaced by or combined with heat or ultrasound sealing elements to obtain the sealing of each piece during its transit.

The invention claimed is:

1. A machine for making filter bags for infusion products starting from pieces of filter material each having two free ends, and an intermediate portion, between each of the two free ends, the intermediate portion having, respectively, two chambers containing a corresponding dose of product; the pieces advancing along a feed line of the machine, comprising:

a first carousel for continuous rotary movement about a first axis of rotation and having at least a plurality of first operating stations positioned along, and continuously movable with, the first carousel, each first operating station being configured to retain and operate on a piece of the pieces of filter material fed along at least one predetermined angular stretch of rotation of the first carousel, to obtain at least a lifting of the two chambers to a position side by side and erect, positioned radially relative to the first axis of rotation;

a second carousel positioned alongside the first carousel and rotating continuously about a second axis of rotation parallel to the first axis of rotation; the second carousel having a plurality of joining elements positioned along, and continuously movable with, the second carousel; each joining element being connected to corresponding control devices configured for actuating, in a synchronized fashion with the corresponding rotations of the first and the second carousel and at least along a stretch of predetermined curved path, a succession of movements of the joining element to intercept the two free ends of the erect piece of filter material, positioned on an operating station and joining the two free ends, towards one of the two chambers containing a dose of product.

2. The machine according to claim 1, wherein the second carousel has a number of joining elements less than a number of first operating stations present on the first carousel.

3. The machine according to claim 1, wherein the second carousel rotates at a speed which is different and constant relative to a speed of rotation of the first carousel and with a direction of rotation opposite to a direction of rotation of the first carousel.

4. The machine according to claim 1, wherein the second carousel rotates at a speed which is different and variable relative to a speed of rotation of the first carousel and with a direction of rotation opposite to a direction of rotation of the first carousel.

5. The machine according to claim 1, wherein each of the joining elements comprises a gripper for folding the two free ends of the piece of filter material composed of separate first and second articulated claws along corresponding first and second axes of independent rotation, parallel to each other, and parallel to the second axis of rotation; each first and second articulated claw being connected to a corresponding first and second control device each having at least a first and second motion-transmitting shaft connected by a kinematic mechanism to corresponding cam means positioned inside the second carousel so as to allow a synchronized movement of the first and second articulated claws between at least a non-operating position, wherein the first and second articulated claws are spaced apart, and an operating position for folding/joining the two free ends of the piece of filter material, wherein the first and second articulated claws are in contact with each other and protruding radially from the second carousel.

6. The machine according to claim 5, wherein between the first and the second control device and the first and second articulated claws are interposed corresponding kinematic movement units to allow a rotation for moving away the first and the second articulated claws from the first carousel, in a direction of rotation opposite to a direction of rotation of the second carousel, at the end of the joining of the two free ends of the piece of filter material.

7. The machine according to claim 5, comprising an operating plate interposed between the second carousel and each gripper positioned on the second carousel; each operating plate being articulated along an axis parallel to the second axis of rotation; each operating plate being connected to a corresponding third control device having a third shaft for transmitting the kinematic motion connected with cam means positioned inside the second carousel to allow a rotation of the operating plate, in a synchronized fashion with the movements of the gripper and the rotation of the second carousel at least in a relative stretch of predetermined curved path, between several operating positions along the stretch of curved path wherein the operating plate rotates in a direction opposite a direction of rotation of the second carousel to keep the axis of rotation of the gripper at a constant distance from the first axis of rotation at least at the operating position of folding of the gripper.

8. The machine according to claim 5, wherein the first articulated claw is articulated on the operating plate with the first axis of independent rotation, and wherein the second claw has a first point of articulation coinciding with the first axis of independent rotation of the first claw and a second point of articulation, spaced from the first point of articulation, connected to the corresponding second control device positioned on the second carousel.

9. The machine according to claim 5, wherein each gripper has the first articulated claw with an operating head having a plate with a triangular cross section with a vertex directed towards the second articulated claw, and wherein the second articulated claw has an operating head shaped in two half parts defining a central channel shaped to allow, upon approach of the triangular sheet and in synergy with the triangular sheet, at least a first folding of side edges of flaps of the two free ends of the piece of filter material, with partial relative superposition, towards an inside of the piece of filter material.

10. The machine according to claim 1, comprising a curved contact guide positioned close to the first carousel, at a predetermined distance from the first carousel, and along an operating path of the first carousel for at least a predetermined stretch; the curved contact guide being positioned with a relative first end near a zone for intercepting and joining the two free ends of the piece of filter material by the joining element, in such a way as to keep a formed end of the piece of filter material joined until release of the piece from the first carousel.

11. The machine according to claim 1, wherein the first carousel comprises a plurality of gripping elements positioned along, and continuously movable with, the first carousel, each first gripping element being configured for retaining a respective piece of filter material being formed; each gripping element being associated with a corresponding first operating station.

12. The machine according to claim 1, wherein the first carousel comprises a plurality of translation devices, associated with the first carousel and configured for translating corresponding gripping elements along a direction parallel to the first axis of rotation of the first carousel to bring corresponding gripping elements to the respective pieces of filter material at least for a stretch of the feed line.

* * * * *